US009669909B1

(12) United States Patent
Mear

(10) Patent No.: US 9,669,909 B1
(45) **Date of Patent: *Jun. 6, 2017**

(54) WATER SPRAY COOLING DEVICE FOR A WATERCRAFT

(71) Applicant: Richard Mear, Lake Havasu City, AZ (US)

(72) Inventor: Richard Mear, Lake Havasu City, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/391,404

(22) Filed: Dec. 27, 2016

Related U.S. Application Data

(63) Continuation-in-part of application No. 14/673,953, filed on Mar. 31, 2015.

(51) Int. Cl.

| | |
|---|---|
| ***B63B 35/85*** | (2006.01) |
| ***B63J 2/12*** | (2006.01) |
| ***F01P 3/20*** | (2006.01) |
| ***B05B 9/00*** | (2006.01) |
| ***B05B 9/04*** | (2006.01) |
| ***B05B 9/06*** | (2006.01) |
| *B63B 35/73* | (2006.01) |

(52) U.S. Cl.
CPC ..... *B63B 35/85* (2013.01); *B05B 9/007* (2013.01); *B05B 9/0423* (2013.01); *B05B 9/06* (2013.01); *B63J 2/12* (2013.01); *F01P 3/202* (2013.01); *B63B 35/731* (2013.01)

(58) Field of Classification Search
CPC ..... F24F 6/14; F24F 2001/0085
See application file for complete search history.

(56) References Cited

U.S. PATENT DOCUMENTS

| | | | | |
|---|---|---|---|---|
| 4,871,996 | A | 10/1989 | Tsunamoto et al. | |
| 5,129,584 | A * | 7/1992 | Ridenour | B05B 1/3026 239/579 |
| 5,617,811 | A * | 4/1997 | Johnson | A47C 7/74 114/363 |
| 5,628,273 | A | 5/1997 | Crouse, II | |
| 6,175,969 | B1 | 1/2001 | Edwards | |
| 6,263,826 | B1 | 7/2001 | Key | |
| 6,672,240 | B1 | 1/2004 | Aube | |
| 7,077,338 | B1 | 7/2006 | Williamson | |
| 7,210,637 | B1 | 5/2007 | Johnson | |

* cited by examiner

*Primary Examiner* — Edwin Swinehart

(57) ABSTRACT

The water spray cooling device for a watercraft includes at least one water sprayer that is adaptively secured to a watercraft. The one or more water sprayers are in fluidic communication with a pump via a first conduit. The pump is in fluidic communication with an intake valve via a second conduit. The intake valve is located on a hull of the watercraft in order to collect water, which is then transferred to the pump. The one or more water sprayers spray water onto an occupant of the watercraft. The one or more water sprayers are ideally located on an external surface of the watercraft in order to direct water at a driver of the watercraft.

6 Claims, 4 Drawing Sheets

WATER SPRAY COOLING DEVICE FOR A WATERCRAFT

CROSS REFERENCES TO RELATED APPLICATIONS

This non-provisional application is a continuation in part application filed under CFR 1.53(b). The present application claims priority under 35 USC 120 to U.S. non-provisional application Ser. No. 14/673,953 filed on Mar. 31, 2015 by the inventor Richard Mear.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of watercraft, more specifically, a device that sprays water at the driver of a personal watercraft.

SUMMARY OF INVENTION

The water spray cooling device for a watercraft includes one or more water sprayers that are adaptively secured to a personal watercraft. The one or more water sprayers are in fluid connection with a pump via a first conduit. The pump is in fluid connection with an intake valve via a second conduit. The one or more water sprayers are adapted to spray water onto an occupant of said watercraft. The one or more water sprayers are ideally located on an external surface of said watercraft in order to direct water at a driver of said watercraft.

These together with additional objects, features and advantages of the water spray cooling device for a watercraft will be readily apparent to those of ordinary skill in the art upon reading the following detailed description of the presently preferred, but nonetheless illustrative, embodiments when taken in conjunction with the accompanying drawings.

In this respect, before explaining the current embodiments of the water spray cooling device for a watercraft in detail, it is to be understood that the water spray cooling device for a watercraft is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water spray cooling device for a watercraft.

It is therefore important that the claims be regarded as including such equivalent construction insofar as they do not depart from the spirit and scope of the water spray cooling device for a watercraft. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
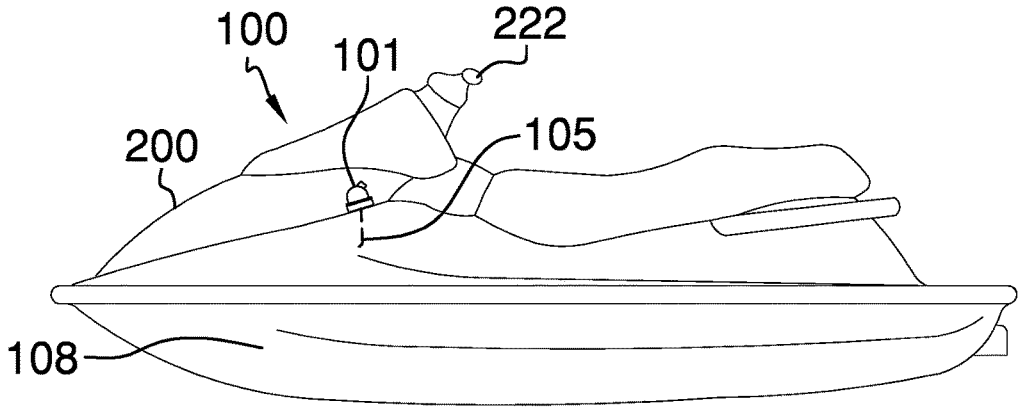
FIG. 1 is a side view of an embodiment of the disclosure.
Figure 2:
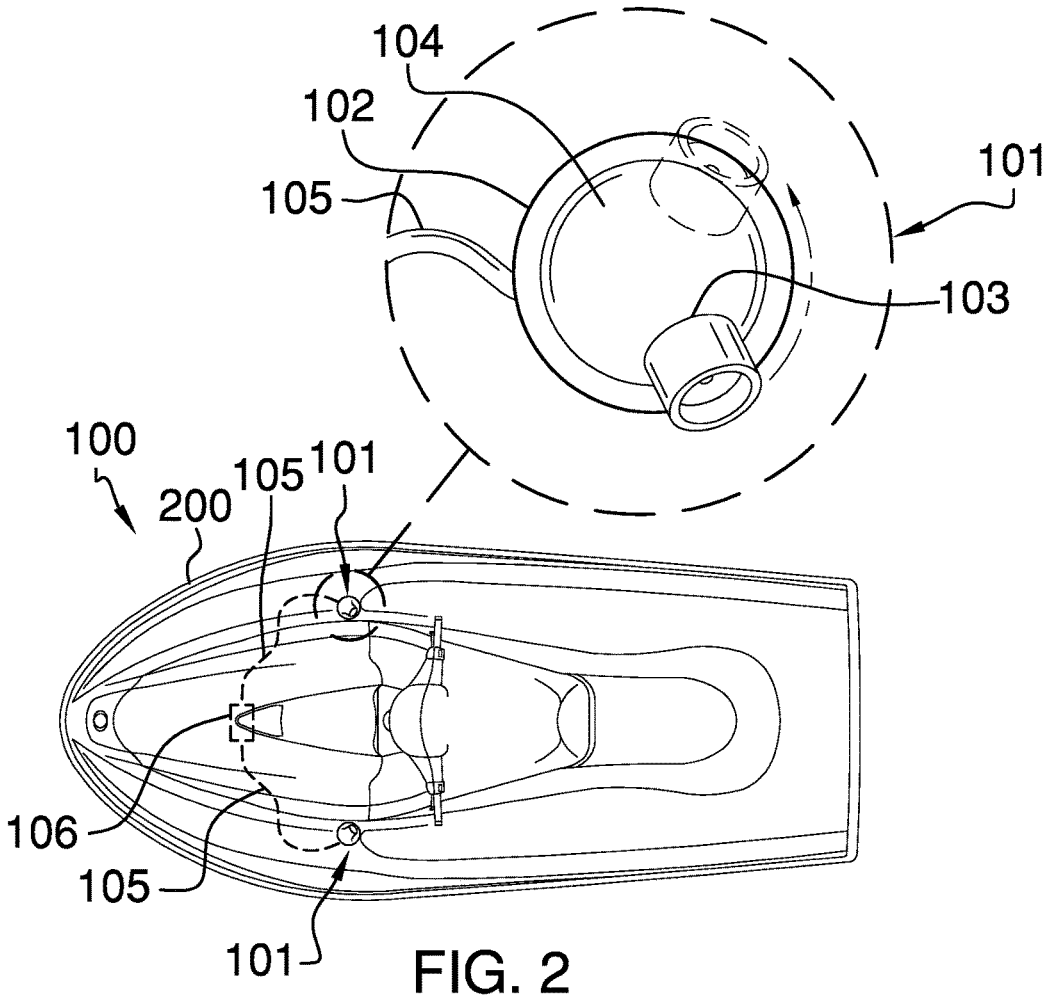
FIG. 2 is a top view of an embodiment of the disclosure.
Figure 3:
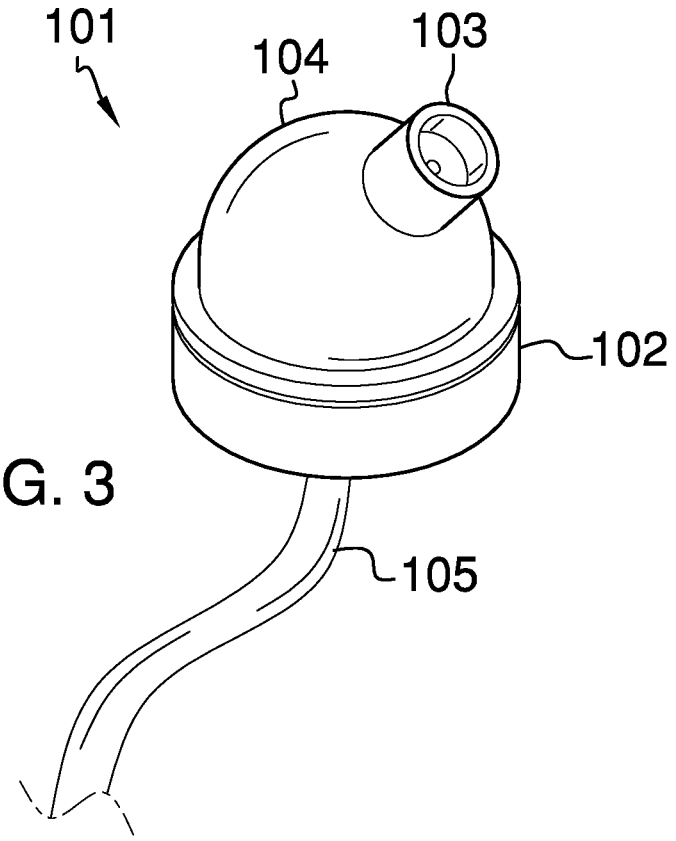
FIG. 3 is a detail of a water sprayer of an embodiment of the disclosure.
Figure 4:
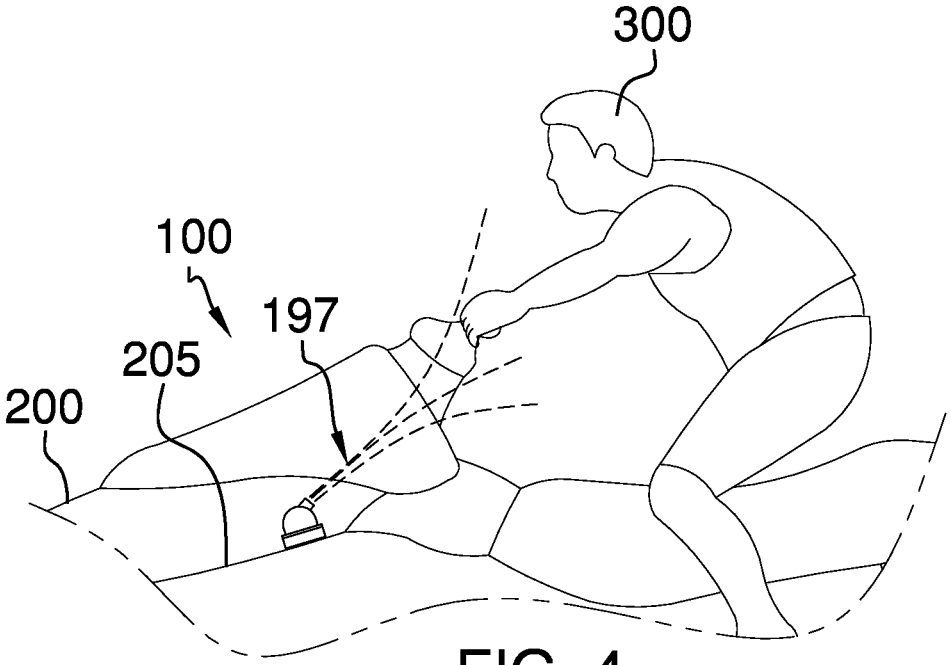
FIG. 4 is a view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The water spray cooling device for a watercraft 100 (hereinafter invention) comprises one or more water sprayers 101 that are adapted to be mounted onto a personal watercraft 200. It shall be noted that the term "personal watercraft" is being used to refer to a recreational watercraft that the rider sits or stands on, and that is propelled via an impeller. In this scenario, the personal watercraft 200 is further defined with an engine 206. The engine 206 is further defined with a cooling water line 207. The engine 206 is a mechanical device that provided the motive forces required to move the personal watercraft 200. The cooling water line 207 is a pipe that delivers pressurized cooling water to the engine 206 of the personal watercraft 200 for the purpose of cooling the engine 206. The cooling water is typically water drawn from the body of water within which the personal watercraft 200 is operating.

The one or more water sprayers 101 include a base member 102 from which a spray armature 103 is pivotally-engaged. The spray armature 103 is able to pivot with respect to the base member 102 in order to adjust a trajectory of a water spray 197 there from. The spray armature 103 is affixed to a bulbous member 104 that is partially seated in the base member 102. Moreover, the bulbous member 104 and the base member 102 involve a ball and socket combination.

Figure 5:
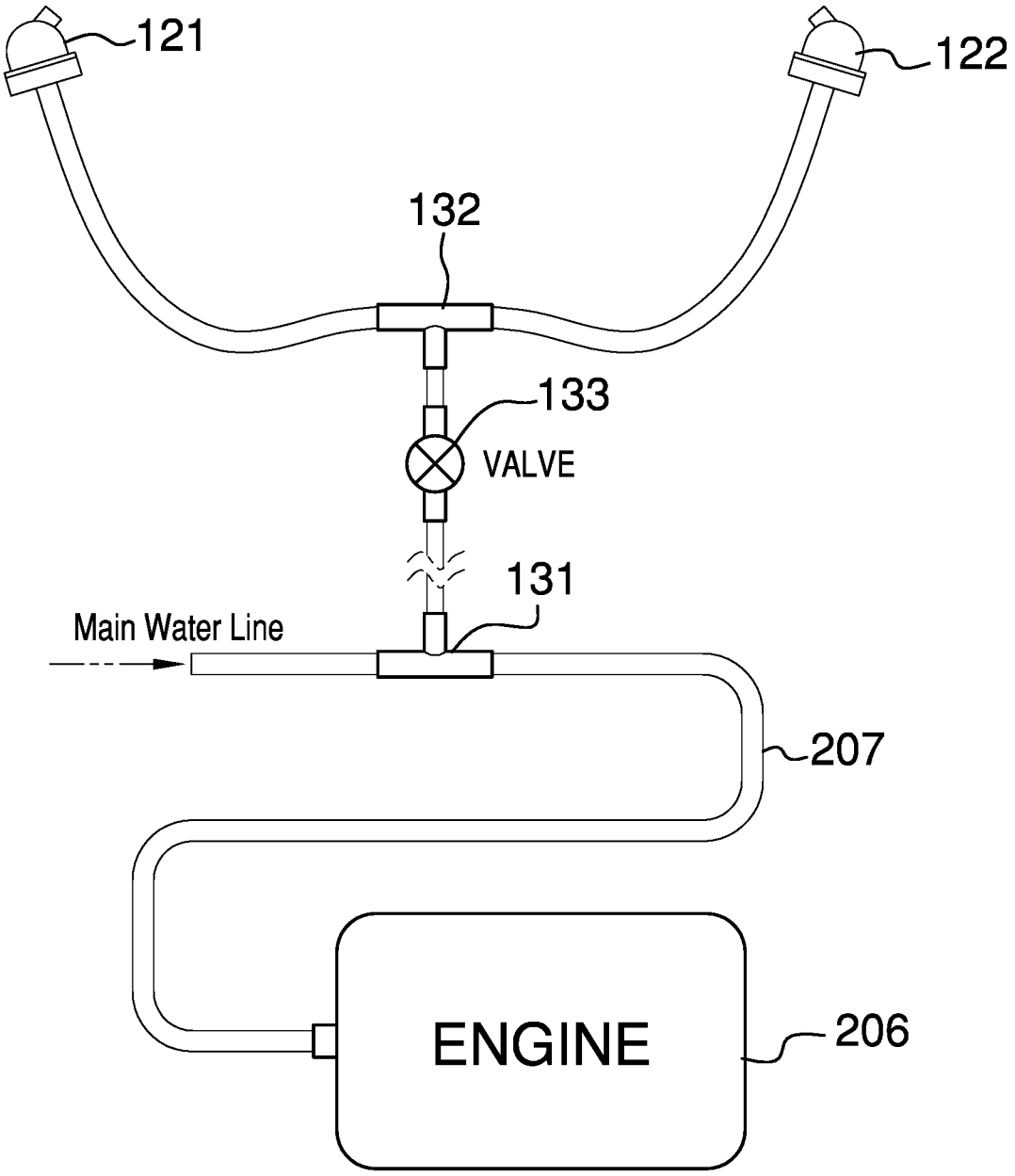
FIG. 5 is a schematic view of an alternate embodiment of the disclosure.
Figure 6:
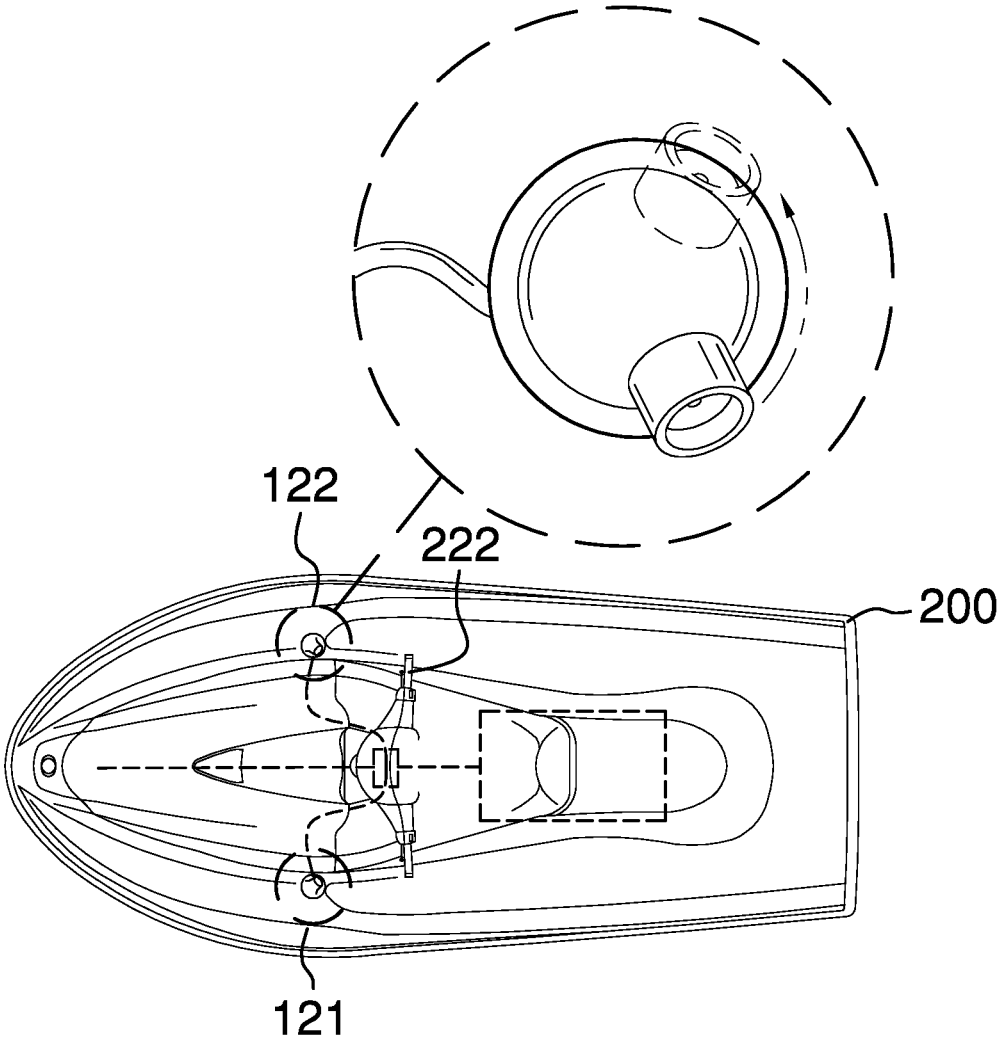
FIG. 6 is a detail view of an alternate embodiment of the disclosure.

As shown most clearly in FIG. 5, the first conduit 105 extends from the base member 102. The first conduit 105 provides fluidic communication between the one or more water sprayers 101 and the cooling water line 207. A diverting valve 133 is placed in the first conduit 105 for the purpose of controlling water flow from the water line 207 and the one or more water sprayers 101.

It shall be noted that, as shown most clearly in FIG. 5, first conduit 105 can be associated with a manifold that distributes water drawn from the cooling water line 207 to a plurality of water sprayers selected from the one or more water sprayers 101 that are incorporated into the specific embodiment of the invention 100.

The one or more water sprayers 101 are ideally located on an exterior surface 205 of said personal watercraft 200 in order to direct water spray 197 at an occupant 300 of said personal watercraft 200. Moreover, the exterior surface 205 of the personal watercraft 200 shall be located in front of the occupant 300 of said personal watercraft 200. In referring to FIGS. 1, 2, and 4, the exterior surface 205 is also ahead of, but below a handlebar 222 of the personal watercraft 200. The invention 100 enables the water spray 197 to be used to cool off the occupants 300 of said personal watercraft 200. The first conduit 105 and the second conduit 108 are of undefined lengths. Moreover, the first conduit 105 and the second conduit 108 may be made of a variety of materials comprising plastic, rubber, copper, etc.

In the first potential embodiment of the disclosure, the one or more water sprayers 101 comprises a first water sprayer 121. The invention 100 further comprises a first Tee connector 131 and a diverting valve 133. The cooling water is delivered under pressure to the engine 206 through the cooling water line 207. The cooling water is typically pressurized by a pump associated with the engine 206. The cooling water is diverted from the cooling water line 207 before the cooling water is pumped into the engine 206. As shown most clearly in FIG. 5, the first Tee connector 131 is inserted into the cooling water line 207. The amount of water drawn from the cooling water line 207 is controlled via the diverting valve 133. The diverting valve 133 is attached to the first Tee connector 131. As shown most clearly in FIG. 5, when the diverting valve 133 is open water flows from the first Tee connector 131 through the diverting valve 133 to the one or more water sprayers 101. Methods to install T connectors and valves in fluidic systems are well known and documented in the plumbing arts.

A second potential embodiment of the disclosure is identical to the first potential embodiment of the disclosure wherein the one or more water sprayers 101 further comprises a second water sprayer 122 and a second Tee connector 132. In this scenario, as shown most clearly in FIG. 6, the diverting valve 133 passes water received from cooling water line 207 and the first Tee connector 131 to the second Tee connector 132. The second Tee connector 132 is a manifold that distributes water received from the diverting valve 133 to the first water sprayer 121 and the second water sprayer 122. Methods to install T connectors in fluidic systems are well known and documented in the plumbing arts.

The following definitions were used in this disclosure:

Conduit: As used in this disclosure, a conduit is a tube, pipe or hose that can be used to transport a fluid or a gas.

Exterior: As used in this disclosure, the exterior is use as a relational term that implies that an object is not contained within the boundary of a structure or a space.

Interior: As used in this disclosure, the interior is use as a relational term that implies that an object is contained within the boundary of a structure or a space.

Manifold: As used in this disclosure, a manifold is a pipe or chamber having several ports through which liquid or gas is gathered or distributed.

Pump: As used in this disclosure, a pump is a mechanical device that uses suction or pressure to raise or move liquids, compress gases, or force a gas into an inflatable object.

Tee Connector: As used in this disclosure, a T Connector is a 3-aperture fitting that is designed to connect three pipes together. A typical T Connector has a two pipe configuration wherein: 1) a first aperture is at a first end of the first pipe; 2) a second aperture is at the second end of the first pipe; 3) a second pipe projects away from the first pipe such that the center axis of the second pipe intersects perpendicularly with the center axis of the first pipe; 4) the second pipe provides access to the interior of the first pipe; and 5) a third aperture is at the end of the second pipe that is distal from the first pipe.

Valve: As used in this disclosure, a valve is a device that is use to control the flow of a fluid (gas or liquid) through a pipe.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A water spray cooling device for a personal watercraft comprising:

one or more water sprayers that are adapted to be mounted onto a personal watercraft;

wherein the personal watercraft is further defined with an engine and a cooling water line;

wherein the one or more water sprayers direct a water spray at an occupant of the personal watercraft;

wherein each of the one or more water sprayers comprises a base member, a spray armature, and a bulbous member;

wherein the a bulbous member that is partially seated in the base member;

wherein the spray armature is affixed to a bulbous member;

wherein the spray armature is pivotally-engaged from the base member;

wherein the spray armature pivots with respect to the base member in order to adjust a trajectory of said water spray there from;

wherein a first conduit extends from the base member;

wherein the first conduit provides fluidic communication between the one or more water sprayers and a pump;

wherein the one or more water sprayers comprises a first water sprayer;

wherein the first water sprayer is in fluidic communication with a diverting valve;

wherein the water spray cooling device for a personal watercraft further comprises a first Tee connector;

wherein the first tee connector is inserted into the cooling water line;

wherein the diverting valve is attached to the first tee connector;

wherein the diverting valve controls the amount of water drawn from the cooling water line;

wherein the diverting valve is installed such that when the diverting valve is open water flows from the first tee connector through the diverting valve to the first water sprayer.

2. The water spray cooling device for a personal watercraft according to claim 1 wherein the pump is a pump associated with the engine of the personal watercraft;

wherein the water delivered to the one or more water sprayers is diverted from the cooling water line.

3. The water spray cooling device for a personal watercraft according to claim 1 wherein the one or more water sprayers further comprises a second water sprayer;

wherein the second water sprayer is in fluidic communication with the diverting valve.

4. The water spray cooling device for a personal watercraft according to claim 3 wherein the diverting valve is installed such that when the diverting valve is open water flows from the first tee connector through the diverting valve to the second water sprayer.

5. The water spray cooling device for a personal watercraft according to claim 4 wherein the water spray cooling device for a personal watercraft further comprises a second Tee connector;

wherein the second T connector is in fluidic communication with the diverting valve.

6. The water spray cooling device for a personal watercraft according to claim 5 wherein the second tee connector is a manifold that distributes water received from the diverting valve to the first water sprayer and the second water sprayer.

* * * * *